US010468801B2

(12) United States Patent
Okuno et al.

(10) Patent No.: US 10,468,801 B2
(45) Date of Patent: Nov. 5, 2019

(54) TERMINAL, TERMINAL-EQUIPPED HOUSING, AND TERMINAL ATTACHING METHOD

(71) Applicant: SCHOTT Japan Corporation, Koka-shi, Shiga (JP)

(72) Inventors: Akira Okuno, Koka (JP); Tetsushi Morikawa, Koka (JP); Tarou Hirai, Koka (JP); Kazuhito Miyawaki, Koka (JP); Masahiro Taketomi, Koka (JP); Yoshinaga Hamaguchi, Koka (JP)

(73) Assignee: SCHOTT Japan Corporation, Koka-shi, Shiga (JP)

( * ) Notice: Subject to any disclaimer, the term of this patent is extended or adjusted under 35 U.S.C. 154(b) by 0 days.

(21) Appl. No.: 16/072,284

(22) PCT Filed: Aug. 8, 2017

(86) PCT No.: PCT/JP2017/028812
§ 371 (c)(1),
(2) Date: Jul. 24, 2018

(87) PCT Pub. No.: WO2018/030423
PCT Pub. Date: Feb. 15, 2018

(65) Prior Publication Data

US 2019/0036255 A1 Jan. 31, 2019

(30) Foreign Application Priority Data

Aug. 12, 2016 (JP) ..... 2016-158358
Feb. 6, 2017 (WO) ..... PCT/JP2017/004208

(51) Int. Cl.
*H01R 13/40* (2006.01)
*H01R 13/03* (2006.01)
(Continued)

(52) U.S. Cl.
CPC ..... *H01R 13/03* (2013.01); *H01R 9/16* (2013.01); *H01R 13/521* (2013.01); *H01R 13/665* (2013.01); *H01R 43/0207* (2013.01)

(58) Field of Classification Search
CPC ..... H01R 13/5205; H01R 12/585; H01R 13/521; H01R 13/665; H01R 13/6658
(Continued)

(56) References Cited

U.S. PATENT DOCUMENTS 6,500,027 B1 * 12/2002 Van Der Sanden ..... H01R 13/5216 439/587
6,616,480 B2 * 9/2003 Kameyama ..... H01R 13/521 439/271
(Continued)

FOREIGN PATENT DOCUMENTS

CN 102388508 A 3/2012
CN 105375129 A 3/2016
(Continued)

OTHER PUBLICATIONS

International Search Report of the International Searching Authority for International Application PCT/JP2017/028812, dated Oct. 24, 2017, 2 pages, Japanese Patent Office, Tokyo, Japan.
(Continued)

*Primary Examiner* — Phuong Chi T Nguyen
(74) *Attorney, Agent, or Firm* — W. F. Fasse

(57) ABSTRACT

A terminal that can be simply joined in the atmosphere; an electrical apparatus including the terminal; and a method of attaching a terminal to a housing made of a metal material by which a passivation film is readily formed on a surface thereof are provided. A terminal can be fixedly adhered to a housing, and includes: a metal outer ring; a lead penetrating through the metal outer ring; and an insulating material providing sealing between the metal outer ring and the lead.
(Continued)

The metal outer ring has a joint edge to be joined to the housing. A coating layer turning into a liquid phase at a temperature lower than a melting temperature of the housing is provided at least in the joint edge.

19 Claims, 5 Drawing Sheets

(51) Int. Cl.
*H01R 9/16* (2006.01)
*H01R 13/52* (2006.01)
*H01R 13/66* (2006.01)
*H01R 43/02* (2006.01)

(58) Field of Classification Search
USPC ..... 439/589, 936
See application file for complete search history.

(56) References Cited

U.S. PATENT DOCUMENTS 7,081,691 B2 * 7/2006 Kawata ..... H05K 1/0203 307/9.1
7,736,158 B2 * 6/2010 Yamaguchi ..... H05K 7/026 439/271
9,065,222 B2 * 6/2015 Drew ..... H01R 12/71
9,728,875 B2 * 8/2017 Summa ..... H01R 12/724
2004/0014356 A1 * 1/2004 Hallitschke ..... H05K 5/0069 439/527
2007/0281501 A1 * 12/2007 Ju ..... H01R 13/2435 439/66
2012/0018216 A1 1/2012 Harada et al.

FOREIGN PATENT DOCUMENTS

JP 54-122089 A 9/1979
JP 2000-223177 A 8/2000
JP 2001-210399 A 8/2001
JP 2001-267440 A 9/2001
JP 2003-179457 A 6/2003
JP 2015-191748 A 11/2015
JP 2016-036000 A 3/2016
TW 201313370 A 4/2013

OTHER PUBLICATIONS

English Translation of PCT Written Opinion of the International Searching Authority for International Application PCT/JP2017/028812, dated Oct. 24, 2017, 13 pages.
Extended European Search Report and Examination Report for European Patent Application No. 17839492.0, dated Jul. 18, 2019, 9 pages, European Patent Office, Munich, Germany.
Chinese Office Action in Chinese Patent Application No. 201780009602.5, dated Jun. 11, 2019, 8 pages, with English translation, 11 pages.

* cited by examiner

TERMINAL, TERMINAL-EQUIPPED HOUSING, AND TERMINAL ATTACHING METHOD

TECHNICAL FIELD

The present invention relates to a terminal, a terminal-equipped housing, and a terminal attaching method.

BACKGROUND ART

As terminals, there are an insulating connector, an insulating terminal, a feed-through, a hermetic terminal, and the like. Japanese Patent Laying-Open No. 2015-191748 (PTD 1) discloses a hermetic terminal as an example. The hermetic terminal disclosed in PTD 1 is configured such that a lead is inserted through an insertion hole of a metal outer ring and sealed with an insulating material.

A hermetic terminal is used when a current is supplied to an electrical device or an element housed inside an airtight container, or when a signal is derived from the electrical device or the element to the outside. In particular, a GTMS (Glass-to-Metal-Seal)-type airtight terminal having a metal outer ring and a lead sealed with insulating glass is roughly classified into two types including a matched sealing-type and a compression sealing-type.

In order to ensure the sealing reliability, it is important to appropriately select materials such that the thermal expansion coefficient of the metal material for the outer ring and the lead matches the thermal expansion coefficient of insulating glass. The insulating glass for sealing is determined by raw materials, required temperature profiles and thermal expansion coefficients of the metal outer ring and the lead.

In the case of matched sealing, the raw material for sealing is selected such that the thermal expansion coefficients of the metal material and the insulating glass match each other as much as possible. In order to ensure the airtight reliability and the electrical insulation properties, the matched sealing-type airtight terminal is generally configured such that a Kovar alloy (54% of Fe, 28% of Ni, 18% of Co) having the same thermal expansion coefficient as that of the glass material in a wide temperature range is used for the metal outer ring and the lead material, which are then sealed with insulating glass such as borosilicate glass.

Conventionally, these terminals may be attached to the opening periphery of a housing with a joining member such as a wax material or solder. Particularly when metal materials allowing easy formation of a passivation film made of a surface compound such as an oxide film, for example, an aluminum alloy and stainless steel, are used as materials of the housing, a special wax material containing a reducing element or flux with strong activity needs to be used in a non-oxidizing atmosphere in order to join the terminal.

CITATION LIST

Patent Document

PTD 1: Japanese Patent Laying-Open No. 2015-191748

SUMMARY OF INVENTION

Technical Problem

However, in the conventional joining method using terminals and joining members as described above, special wax materials for exclusive use and flux with strong activity are indispensable, so that corrosive flux residues need to be removed by cleaning. Also, in order to prevent reoxidation of the housing, the materials and the processes are greatly restricted, for example, since joining should be conducted under the atmosphere of inactive gas such as nitrogen, under the hydrogen reducing atmosphere, or under the non-oxidizing atmosphere such as in a vacuum. Consequently, the conventional joining method requires excessive time and effort, and high cost.

The present invention has been made to solve the above-described problems. An object of the present invention is to provide: a terminal that can be simply joined in the atmosphere; a terminal-equipped housing that is equipped with the terminal; and a method of attaching the terminal to a housing made of a metal material by which a passivation film is readily formed on a surface thereof.

Solution to Problem

A terminal according to one embodiment of the present invention is provided as a terminal that can be fixedly adhered to a housing made of a metal material. The terminal includes: a metal outer ring; a lead penetrating through the metal outer ring; and an insulating material for providing sealing between the metal outer ring and the lead. The metal outer ring has a joint edge to be joined to the housing. A coating layer is provided at least in the joint edge. The coating layer turns into a liquid phase at a temperature lower than a melting temperature of the housing.

In the terminal, the coating layer may be made of a metal material having fluidity and configured to cover the joint edge of the metal outer ring at the temperature at which the coating layer turns into a liquid phase, to prevent oxidation of the housing and the joint edge of the metal outer ring for a prescribed time period.

In the terminal, the coating layer may be made of a metal material selected from the group consisting of Sn, an Sn alloy, an Au alloy, an Ag alloy, and a Cu alloy.

In the terminal, the joint edge may have a protrusion or a recess.

In the terminal, the protrusion may be provided so as to continuously extend in a circumferential manner along the joint edge.

In the terminal, the recess may be provided in a groove shape so as to continuously extend in a circumferential manner along the joint edge.

In the terminal, a plurality of protrusions or a plurality of recesses may be provided.

A terminal-equipped housing according to one embodiment of the present invention includes: a housing in which an electrical device is housed; and the terminal directly joined to the housing.

In the terminal-equipped housing, the housing may be made of a metal material by which a passivation film is readily formed or a metal material having a hard-to-solder surface compound.

In the terminal-equipped housing, the housing may be made of a metal material selected from the group consisting of aluminum, chromium, titanium, iron, nickel, copper, and an alloy thereof.

A terminal attaching method according to one embodiment of the present invention is a terminal attaching method for attaching a terminal to a housing. The terminal includes: a metal outer ring; a lead penetrating through the metal outer ring; and an insulating material for providing sealing between the metal outer ring and the lead. The metal outer ring has a joint edge to be joined to the housing. A coating layer is provided at least in the joint edge. The coating layer turns into a liquid phase at a temperature lower than a melting temperature of the housing. The terminal attaching method includes: preparing the terminal and a housing that is made of a metal material and has an insertion hole; positioning and placing the terminal at the insertion hole of the housing; and while heating at least a joint portion between the terminal and the housing to the temperature lower than the melting temperature of the housing, breaking a passivation film formed on a joint portion of the housing using a mechanical method, causing the coating layer, which is molten, to seal a gap between a contact surface of the metal outer ring and a contact surface of the joint portion of the housing, and fixedly adhering the metal outer ring and the housing to each other while preventing reoxidation of the joint portion of the housing.

The terminal attaching method may further include: preheating the housing between placing the terminal at the insertion hole and fixedly adhering the metal outer ring and the housing to each other.

In the terminal attaching method, the mechanical method may include bringing the joint edge and the joint portion of the housing into contact with each other, to which vibrations are applied, to scratch a surface of the joint portion of the housing, and press the joint edge and the housing against each other.

In the terminal attaching method, the mechanical method may include heating and melting the coating layer, and applying an ultrasonic wave to the joint edge, to break the passivation film on the joint portion of the housing so as to expose a newly formed surface.

In the terminal attaching method, in applying an ultrasonic wave to the joint edge, an ultrasonic horn may be brought into contact with the joint edge.

In the terminal attaching method, the ultrasonic wave may have a frequency greater than 28 kHz and less than 1 MHz.

In the terminal attaching method, the mechanical method may include bringing a protrusion or a recess provided in the joint edge into contact with the joint portion of the housing, and pressing the protrusion or the recess against the joint portion of the housing, to cause the protrusion or the recess to scratch a surface of the joint portion of the housing and intrude into the surface of the joint portion while sliding on the surface of the joint portion, so as to press the joint edge and the joint portion of the housing against each other.

In the terminal attaching method, the housing may be made of a metal material by which a passivation film is readily formed or a metal material having a hard-to-solder surface compound.

In the terminal attaching method, the housing may be made of a metal material selected from the group consisting of aluminum, chromium, titanium, iron, nickel, copper, and an alloy thereof.

Advantageous Effects of Invention

According to the present invention, it becomes possible to provide: a terminal that can be simply joined in the atmosphere; a terminal-equipped housing that is equipped with the terminal; and a method of attaching the terminal to a housing made of a metal material by which a passivation film is readily formed on a surface thereof.

DESCRIPTION OF EMBODIMENTS

First Embodiment

Figure 1A:
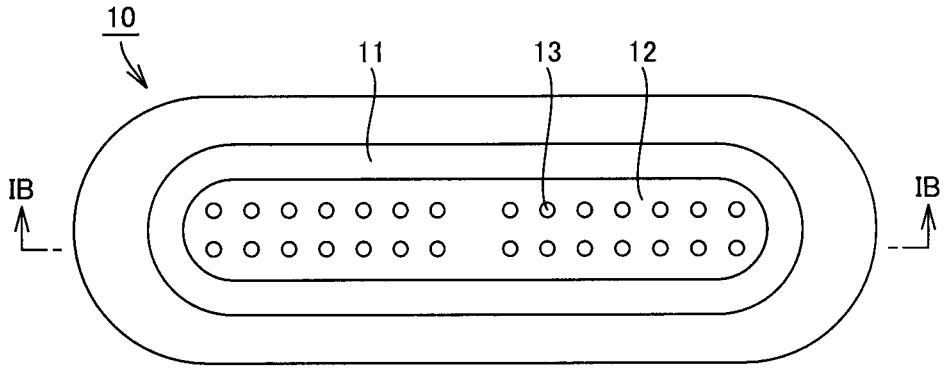
FIG. 1A is a plan view showing a terminal according to the first embodiment.
Figure 1B:
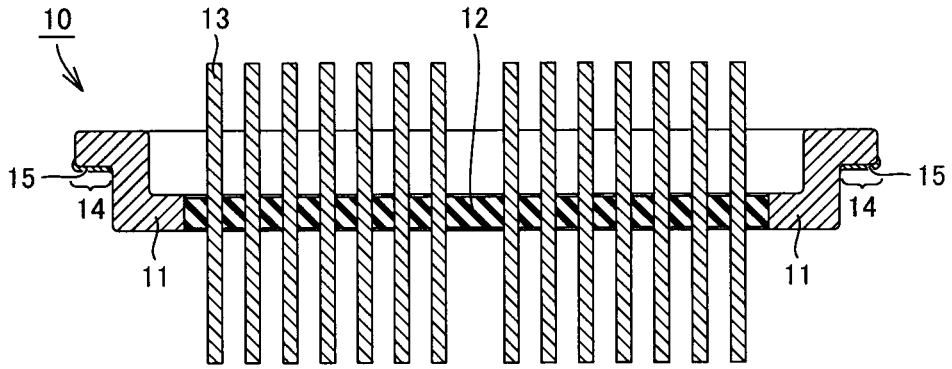
FIG. 1B is a cross-sectional view of the terminal according to the first embodiment taken along an arrow line 1B-1B in FIG. 1A.
Figure 1C:
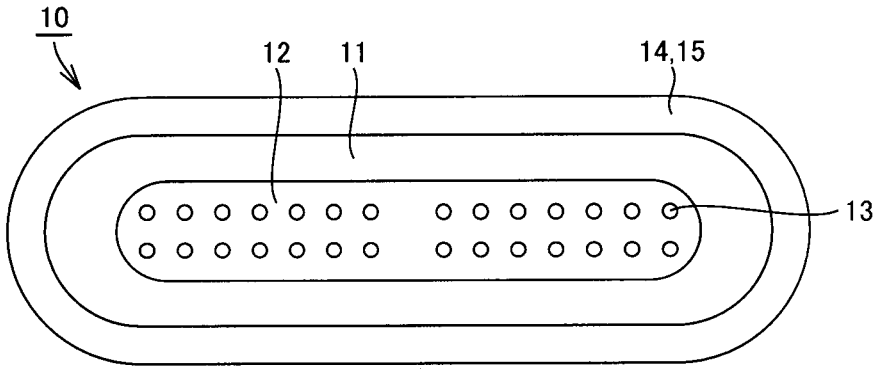
FIG. 1C is a bottom view showing the terminal according to the first embodiment.

In the following, a terminal according to the first embodiment will be described with reference to FIGS. 1A to 1C. A terminal 10 according to the present embodiment is provided as a terminal that is to be fixedly adhered to a housing made of a metal material by which a passivation film is readily formed on a surface thereof. Terminal 10 includes: a metal outer ring 11; a lead 13 penetrating through metal outer ring 11; and an insulating material 12 for providing sealing between metal outer ring 11 and lead 13.

In the present specification and claims, the passivation film may include a coating film-shaped substance existing on the metal surface and preventing joining, for example, a coating film made of compounds such as oxide, sulfide, nitride, chloride, a carbonate compound, and a hydroxide compound.

Metal outer ring 11 is formed in an annular shape having a center portion provided with a through hole. Metal outer ring 11 has an outer circumferential portion provided with a flange portion protruding outward. The flange portion has a bottom surface shown in FIG. 1B, which forms a joint edge 14 to be joined to a housing. There is a level difference between the flange portion and the portion of metal outer ring 11 where a through hole is provided.

Lead 13 penetrates through the through hole of metal outer ring 11. The gap between metal outer ring 11 and lead 13 is filled with an insulating material 12 such as a glass material, a ceramic material, a glass ceramic material, and a plastic material, so that the gap is sealed thereby. Lead 13 is sealed onto metal outer ring 11 with insulating material 12.

Metal outer ring 11 is, for example, made of carbon steel, stainless steel, an Fe—Ni alloy, an Invar alloy, a Kovar alloy, and the like. Lead 13 is, for example, made of an Fe—Ni alloy, an Fe—Cr alloy, a Kovar alloy, and the like.

Joint edge 14 has a coating layer 15 made of a metal material that melts at a temperature lower than the melting temperatures of metal outer ring 11 and the housing. The surface of joint edge 14 is covered by coating layer 15. Coating layer 15 can be formed using materials such as Sn, a Sn alloy, an Au alloy, an Ag alloy, and a Cu alloy, for example, and particularly, suitably using Sn and an Sn alloy. Examples of an Sn alloy may be an Sn—Cu alloy, an Sn—Ag alloy, and the like.

For the purpose of preventing corrosion and diffusion, metal outer ring 11 may be provided with a plating layer made of Au, Ni, an Ni—P alloy or the like as an underlying layer of coating layer 15. The method of providing coating layer 15 may be any method as long as coating layer 15 can be fixedly adhered to or stacked on metal outer ring 11. The film forming method or the fixing method is not particularly limited, but various types of plating, cladding and the like can be suitably utilized, for example.

Terminal 10 in the first embodiment can be configured as described below by way of example. Terminal 10 is joined to a housing made of stainless steel, and includes: metal outer ring 11 made of a Kovar alloy; insulating material 12 made of soda barium glass and sealed onto this metal outer ring 11; and lead 13 made of a Kovar alloy and penetrating through and sealed onto insulating material 12. Metal outer ring 11 has an outer circumference provided with joint edge 14. Coating layer 15 made of an Sn alloy is formed in joint edge 14.

Second Embodiment

Figure 2A:
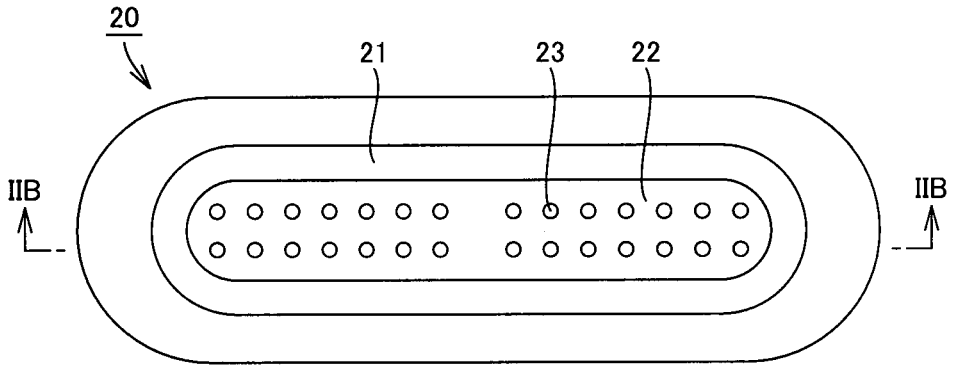
FIG. 2A is a plan view showing a terminal according to the second embodiment.
Figure 2B:
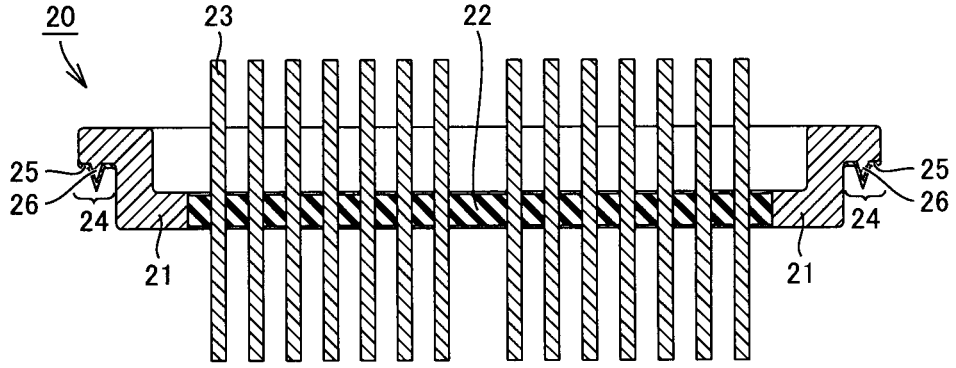
FIG. 2B is a cross-sectional view of the terminal according to the second embodiment taken along an arrow line IIB-IIB in FIG. 2A.
Figure 2C:
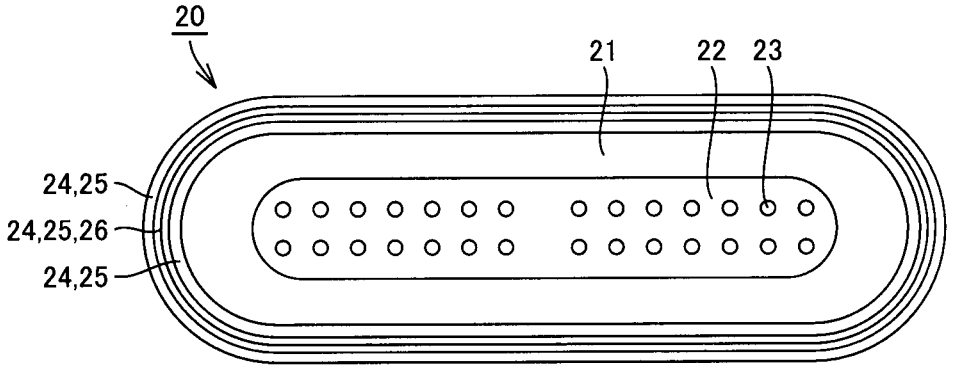
FIG. 2C is a bottom view showing the terminal according to the second embodiment.

Then, a terminal according to the second embodiment will be hereinafter described with reference to FIGS. 2A to 2C. The difference between the second embodiment and the first embodiment will be mainly described.

In the second embodiment, joint edge 14 is provided with a protrusion 26. As shown in FIG. 2B, protrusion 26 is provided on joint edge 24 of metal outer ring 21, that is, on the joint surface to be joined to the housing. It is preferable that protrusion 26 is formed to have a convex-shaped cross section. Protrusion 26 is provided so as to protrude toward the housing to be joined. It is preferable that protrusion 26 is provided so as to continuously extend in a circumferential manner along joint edge 24. A plurality of protrusions 26 may be provided. Protrusions 26 may be provided so as to extend in a circumferential manner in two lines. In other words, a plurality of protrusions 26 may be provided so as to extend in parallel with each other. In the present embodiment, protrusion 26 has a tip end portion formed in the shape having an edge, that is, formed in a sharpened shape.

When terminal 20 is joined to the housing, protrusion 26 serves to stretch and cleave the passivation film existing in the joint portion of the housing by interface sliding, or serves to break the passivation film with its edge portion, thereby exposing a newly formed surface of the metal base material.

In the joining step, when protrusion 26 is brought into contact with and pressed against the housing, protrusion 26 intrudes into the housing. The passivation films on both protrusion 26 and the housing are cleaved by interface sliding of the housing, thereby exposing newly formed surfaces. At this time, coating layer 25 is heated to a joining operation temperature and turned into a liquid phase. Thus, the contact surface of the joint portion in the housing is entirely sealed by coating layer 25 thoroughly covering the gaps so as to prevent intrusion of oxygen and the like. Since the newly formed surfaces exposed in the liquid phase of coating layer 25 are further pressed so as to slide against each other, the housing and terminal 20 are readily and reliably joined to each other.

In the present embodiment, protrusion 26 does not necessarily have to continuously extend in a circumferential manner. For example, also by arranging a plurality of protrusions 26 at regular intervals, the effect of breaking the passivation film is achieved.

A terminal 20 in the second embodiment can be configured as described below by way of example. Terminal 20 is joined to a housing made of an aluminum alloy and includes: a metal outer ring 21 made of a Kovar alloy; an insulating material 22 made of borosilicate glass and sealed onto this metal outer ring 21; and a lead 23 made of a Kovar alloy and penetrating through and sealed onto insulating material 22. Metal outer ring 21 has an outer circumference provided with a joint edge 24. This joint edge 24 has a coating layer 25 made of Sn. Joint edge 24 is provided with a protrusion 26 that intrudes into the passivation film of the housing made of an aluminum alloy to cleave the passivation films on both the housing and protrusion 26 by interface sliding, thereby exposing newly formed surfaces. Protrusion 26 is provided so as to extend in a circumferential manner along joint edge 24.

Third Embodiment

Figure 3A:
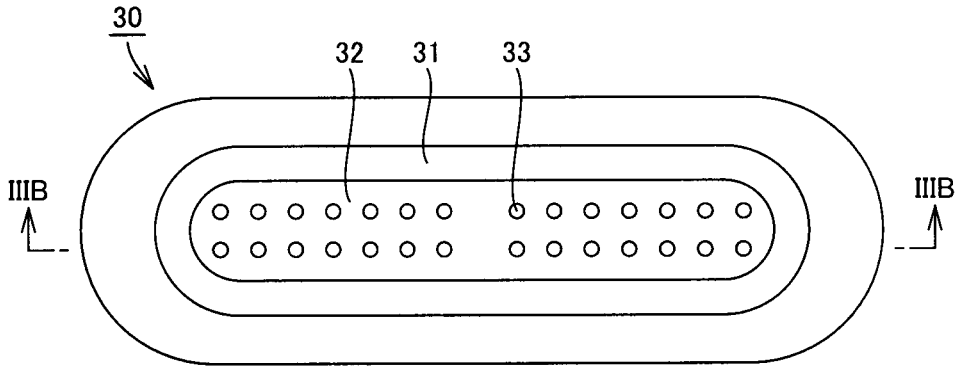
FIG. 3A is a plan view showing a terminal according to the third embodiment.
Figure 3B:
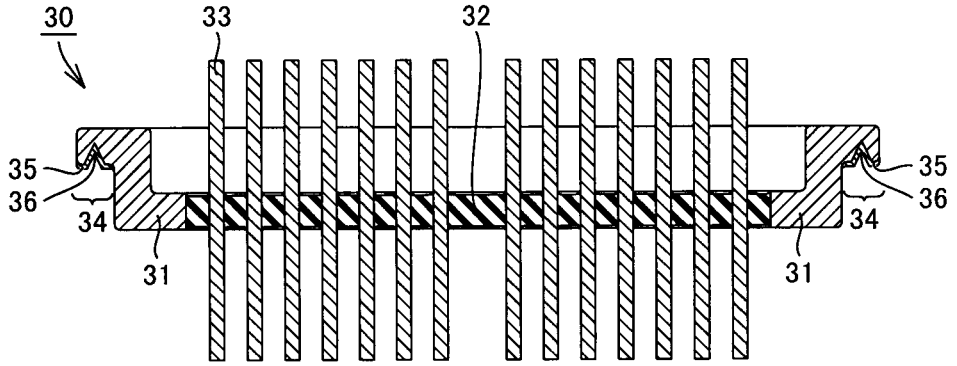
FIG. 3B is a cross-sectional view of the terminal according to the third embodiment taken along an arrow line IIIB-IIIB in FIG. 3A.
Figure 3C:
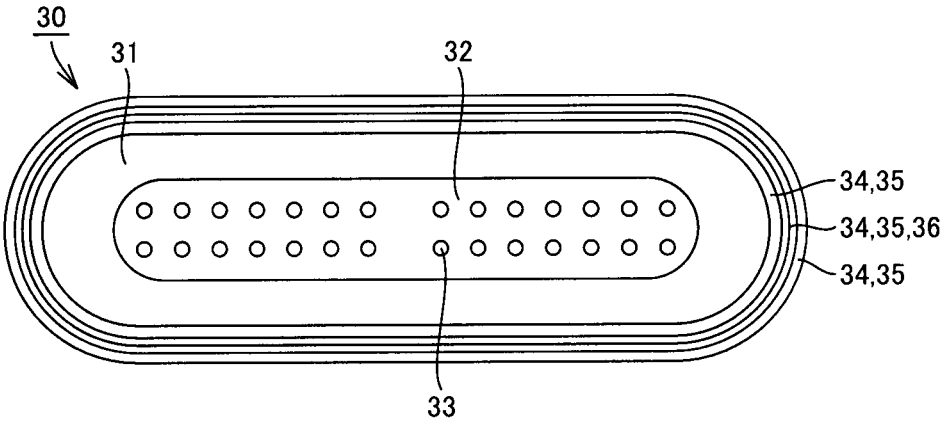
FIG. 3C is a bottom view showing the terminal according to the third embodiment.

The terminal according to the third embodiment will be hereinafter described with reference to FIGS. 3A to 3C. The difference between the third embodiment and the second embodiment will be hereinafter mainly described.

In the second embodiment, protrusion 26 is provided on joint edge 24. In the present embodiment, as shown in FIG. 3B, a recess 36 is provided in joint edge 34 in place of protrusion 26. Recess 36 is provided in joint edge 34 of metal outer ring 31, that is, in the joint surface to be joined to the housing. It is preferable that recess 36 is formed to have a concave-shaped cross section. It is preferable that recess 36 is provided so as to continuously extend in a circumferential manner along joint edge 34, that is, in a groove shape. Recesses 36 may be provided so as to extend in a circumferential manner in two lines. In other words, a plurality of grooves formed of recesses 36 may be provided in parallel with each other.

When terminal 30 is joined to the housing, recess 36 serves to stretch and cleave the passivation film existing in the joint portion of the housing by interface sliding, or serves to break the passivation film with its edge portion between the surface portion and recess 36, thereby exposing a newly formed surface of the metal base material.

In the joining step, when joint edge 34 provided with recess 36 is brought into contact with the housing and pressed against the housing, interface sliding of the housing is facilitated due to existence of recess 36, to cleave the passivation films on both joint edge 34 and the housing, thereby exposing newly formed surfaces. At this time, coating layer 35 is heated to a joining operation temperature and turned into a liquid phase. Thus, the contact surface of the joint portion in the housing is entirely sealed by coating layer 35 thoroughly covering the gaps so as to prevent intrusion of oxygen and the like. Since the newly formed surfaces exposed in the liquid phase of coating layer 35 are further pressed so as to slide against each other, the housing and terminal 30 are readily and reliably joined to each other.

In the present embodiment, recess 36 does not necessarily have to continuously extend in a circumferential manner. For example, also by arranging a plurality of recesses 36 at regular intervals, the effect of breaking the passivation film is achieved.

Terminal 30 in the third embodiment is configured as described below by way of example. Terminal 30 is joined to a housing made of an aluminum alloy, and includes: a metal outer ring 31 made of a Kovar alloy; an insulating material 32 made of borosilicate glass and sealed onto this metal outer ring 31; and a lead 33 made of a Kovar alloy and penetrating through and sealed onto insulating material 32. Metal outer ring 31 has an outer circumference provided with a joint edge 34. This joint edge 34 has a coating layer 35 made of Sn. Joint edge 34 is provided with a recess 36 that intrudes into the passivation film of the housing made of an aluminum alloy to cleave the passivation films on both the housing and joint edge 34 by interface sliding, thereby exposing newly formed surfaces. Recess 36 is provided so as to extend in a circumferential manner along joint edge 34.

(Method of Attaching Terminal to Housing)

Figure 4:
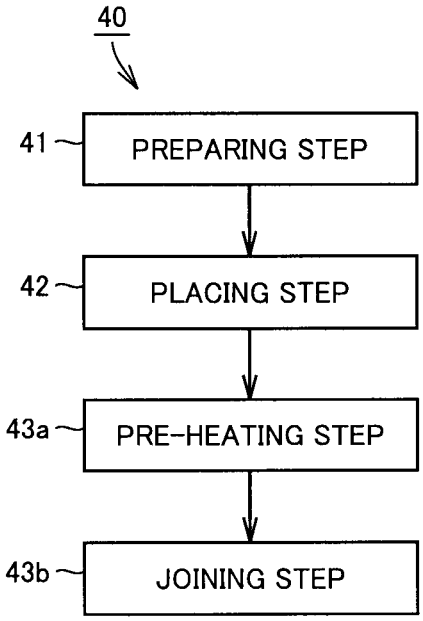
FIG. 4 is a flowchart illustrating the steps of a method of attaching a terminal to a housing.

A method of attaching a terminal to a housing according to each embodiment will be hereinafter described based on a flowchart 40 in FIG. 4. As shown in FIG. 4, the method of attaching a terminal to a housing in the present embodiment includes a preparing step 41, a placing step 42, and a joining step 43*b*.

In preparing step 41, terminals 10, 20 and 30 as shown in the first to third embodiments as described above; and a housing made of a metal material allowing easy formation of a passivation film and having an insertion hole are prepared. Terminals 10, 20, and 30 respectively include: metal outer rings 11, 21, and 31; leads 13, 23, and 33 respectively penetrating through metal outer rings 11, 21, and 31; and insulating materials 12, 22, and 32 respectively providing sealing between metal outer rings 11, 21, and 31 and leads 13, 23, and 33. Metal outer rings 11, 21, and 31 respectively have joint edges 14, 24, and 34 to be joined to the housing. Coating layers 15, 25, and 35 are respectively provided at least in joint edges 14, 24, and 34. Coating layers 15, 25, and 35 each turn into a liquid phase at a temperature lower than the melting temperature of the housing.

In placing step 42, terminals 10, 20, and 30 are positioned and placed in a prescribed portion of the insertion hole in the housing.

In joining step 43*b*, while heating at least the joint portion between the housing and each of terminals 10, 20, and 30 to a temperature lower than the melting temperature of the housing, the passivation film on the joint portion of the housing is broken using a mechanical method, and molten coating layers 15, 25, and 35 seal a gap between the contact surface of each of metal outer rings 11, 21, 31 and the contact surface of the joint portion in the housing. In the state where reoxidation of the joint portion in the housing is prevented by each of molten coating layers 15, 25, and 35, the housing and each of metal outer rings 11, 21, and 31 are fixedly adhered to each other.

In this case, as a mechanical method, each of joint edges 14, 24, and 34 and the joint portion of the housing may be brought into contact with each other and then vibrated, to thereby scratch the surface of the joint portion, and press each of joint edges 14, 24, and 34 and the housing against each other.

As a mechanical method, an ultrasonic wave may be used. This method will be described later.

As a mechanical method, protrusions 26 and 56 or recess 36 provided in the joint edge may be brought into contact with the joint portion of the housing and pressed against this joint portion, to cause protrusions 26 and 56 or recess 36 to scratch the surface of the joint portion of the housing and then intrude into the surface of the joint portion while sliding on this surface, thereby pressing the joint edge and the joint portion of the housing against each other.

The housing is formed of a metal material by which a passivation film is readily formed on the surface thereof, such as aluminum, chromium, titanium, iron, nickel, copper, and an alloy thereof, for example.

In the attaching method as described above, a pre-heating step 43*a* of raising a temperature and heating the housing in advance may be performed as required between placing step 42 and joining step 43*b*.

Using the terminal attaching method as described above, a terminal can be attached to a housing made of an aluminum alloy in the following steps by way of example.

In preparing step 41, a terminal having a coating layer made of Sn on a joint edge, and a housing made of an aluminum alloy are prepared. Then, in placing step 42, the terminal is positioned and placed in a prescribed portion of the insertion hole in the housing. Then, in joining step 43*b*, a protrusion on the joint edge is pressed while heating the joint portion between the terminal and the housing to 300° C. Thereby, the passivation film on the housing made of an aluminum alloy is broken, and the gap between the contact surface of the metal outer ring and the contact surface of the housing is sealed by the molten coating layer made of Sn. Then, the metal outer ring and the housing are joined to each other while preventing reoxidation of the material to be joined.

(Method of Attaching Terminal to Housing (in Case of Using Ultrasonic Wave))

A method of attaching a terminal to a housing according to each embodiment in the case of using an ultrasonic wave as the mechanical method described above will be hereinafter described again with reference to flowchart 40 in FIG. 4. As shown in FIG. 4, the method of attaching a terminal to a housing in the present embodiment includes preparing step 41, placing step 42, and joining step 43*b*.

In preparing step 41, terminals 10, 20 and 30 as shown in the above-described first to third embodiments; and a housing made of a metal material allowing easy formation of a passivation film and having an insertion hole are prepared. Terminals 10, 20, and 30 respectively include: metal outer rings 11, 21, and 31; leads 13, 23, and 33 respectively penetrating through metal outer rings 11, 21, and 31; and insulating materials 12, 22, and 32 respectively providing sealing between metal outer rings 11, 21, and 31 and leads 13, 23, and 33. Metal outer rings 11, 21, and 31 respectively have joint edges 14, 24, and 34 to be joined to the housing. Coating layers 15, 25, and 35 are respectively provided at least in joint edges 14, 24, and 34. Coating layers 15, 25, and 35 each turn into a liquid phase at a temperature lower than the melting temperature of the housing.

In placing step 42, terminals 10, 20 and 30 each are positioned and placed in a prescribed portion of the insertion hole in the housing.

In joining step 43*b*, while heating at least the joint portion between the housing and each of terminals 10, 20, and 30 to a temperature lower than the melting temperature of the housing, the passivation film on the joint portion of the housing is broken using an ultrasonic wave as a mechanical method, and each of molten coating layers 15, 25, and 35 seals a gap between the contact surface of each of metal outer rings 11, 21, 31 and the contact surface of the joint portion in the housing.

Figure 5:
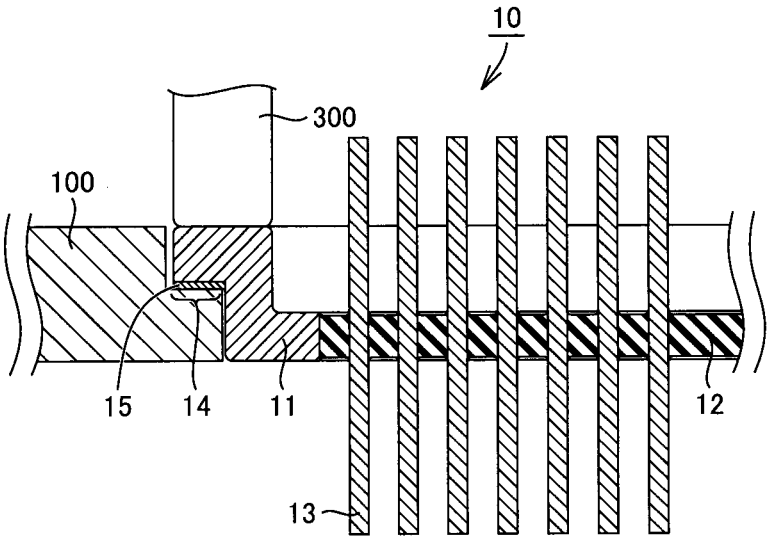
FIG. 5 is a diagram showing the step of joining the terminal according to the first embodiment to the housing by way of example.

FIG. 5 is a diagram showing the step of joining terminal 10 to housing 100 according to the first embodiment by way of example. More specifically, in the state where coating layers 15, 25, and 35 are molten by heating, an ultrasonic horn 300 is brought into contact with a flange portion (joint edge 14 in FIG. 5) provided in the metal outer ring as shown in FIG. 5. By applying an ultrasonic wave to the flange portion, cavitation is produced in coating layers 15, 25, and 35 each in a liquid phase. The method of applying an ultrasonic wave is not limited to the method of using an ultrasonic horn, but may be any method as long as ultrasonic wave vibrations can be transmitted. FIG. 5 shows ultrasonic horn 300 having a shaft shape, but may be formed in any other shape. A plurality of ultrasonic horns may be used.

Cavitation is produced by an ultrasonic wave, to break and cleave the passivation film formed on the housing and made of an oxide film or the like, thereby exposing a newly formed surface. Simultaneously, when passivation films and the like are formed on metal outer rings 11, 21 and 31, these passivation films can also be cleaved so as to expose newly formed surfaces.

In the state where reoxidation of the joint portion in the housing is prevented by each of molten coating layers 15, 25, and 35, the housing and each of metal outer rings 11, 21, and 31 are fixedly adhered to each other.

The housing is formed of a metal material by which a passivation film is readily formed on the surface thereof, such as aluminum, chromium, titanium, iron, nickel, copper, and an alloy thereof, for example.

Although an ultrasonic wave applied in the above-mentioned joining step 43*b* is not particularly limited, it is preferable to use an ultrasonic wave having a frequency greater than 28 kHz and less than 1 MHz. Further preferably, an ultrasonic wave having a frequency of 60 kHz or higher and 100 kHz or lower may be used. When the frequency is too low, a stirring effect poses a problem to be solved. For example, aluminum excessively permeates through the joint surface. Thus, a brittle intermetallic compound is produced, so that the joining strength is weakened. When the frequency is too high, the cavitation bubbles produced in the coating layer in a liquid phase are too small, with the result that an effect of sufficiently crushing the passivation film cannot be achieved.

(Terminal-Equipped Housing)

A terminal-equipped housing 50 implemented using terminals 10, 20 and 30 according to the first to third embodiments will be hereinafter described with reference to FIG. 6. A terminal is directly joined to a housing in which an electrical device is housed, so that terminal-equipped housing 50 can be configured.

Figure 6:
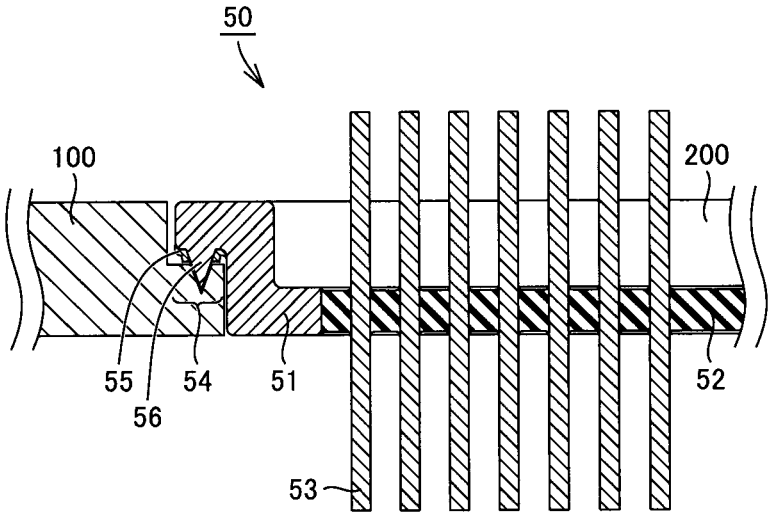
FIG. 6 is a cross-sectional view showing an attachment portion between a terminal and a housing in a terminal-equipped housing according to one embodiment.

A housing 100 shown in a partial cross-sectional view in FIG. 6 can house electrical devices such as a sensing device, a motor driving device, a signal processing device, and an external storage device, for example. A terminal 200 is directly joined to this housing 100. Housing 100 has an insertion hole through which terminal 200 is inserted.

Terminal 200 includes a metal outer ring 51, an insulating material 52 fixedly adhered to this metal outer ring 51, and a lead 53 penetrating through metal outer ring 51 and sealed by insulating material 52. Metal outer ring 51 has a joint edge 54 that is joined to housing 100 in which electrical devices as described above are housed.

Joint edge 54 of housing 100 and terminal 200 has a coating layer 55 that is made of a material selected from Sn, an Sn alloy, an Au alloy, an Ag alloy, and a Cu alloy. Coating layer 55 is provided so as to extend around the edge of the insertion hole of housing 100. Joint edge 54 is provided with a protrusion 56.

Housing 100 is formed of a metal material by which a passivation film is readily formed on the surface thereof, such as aluminum, chromium, titanium, iron, nickel, copper, and an alloy thereof, for example.

Terminal-equipped housing 50 as described above is configured as described below by way of example. Terminal-equipped housing 50 includes: a housing 100 made of an aluminum alloy for housing an external storage device therein; and a terminal 200 directly joined to this housing 100. Terminal 200 includes: a metal outer ring 51 made of a Kovar alloy; an insulating material 52 made of borosilicate glass and sealed onto metal outer ring 51; and a lead 53 made of a Kovar alloy and sealed by this insulating material 52. Metal outer ring 51 has a joint edge 54 joined to housing 100. An Sn coating layer 55, which provides sealing so as to cover at least the exposed end face, is disposed so as to prevent the joint portion between housing 100 and terminal 200 from contacting the atmosphere. Coating layer 55 has an insertion hole through which terminal 200 is inserted into housing 100, and is provided so as to extend around the edge of this insertion hole. An electrical apparatus can be configured by housing electrical devices such as an external storage device in terminal-equipped housing 50.

For example, when the electrical apparatus is a hard disk device, electrical devices include a recording disk, a voice coil motor having a magnetic head configured to read and write data from and onto the recording disk, and a spindle motor configured to rotate the recording disk at high speed. The electrical devices including the above devices are airtightly housed in housing 100 made of an aluminum alloy.

The function of the coating layer in each of the embodiment as described above will be hereinafter explained. The coating layer is provided in the joint edge of the terminal in advance. When this coating layer is molten, this coating layer adheres to the joint edge and covers the surface thereof without being repelled from the surface of the joint edge in the metal outer ring. Thereby, in the state where the metal outer ring and the housing are brought into contact with each other so as to be joined to each other, the gap between the mating faces of materials to be joined is filled and sealed (covered) so as to prevent intrusion of oxidizing substances such as oxygen in the atmosphere.

When mechanical force is applied to the materials to be joined in this state to break the passivation films on the surfaces thereof so as to expose newly formed surfaces of the metal base materials, the materials to be joined are readily joined to each other at their newly formed surfaces or coating layer metals. In other words, the coating layer in each of the above-described embodiments has a function of directly covering the interface between the metal outer ring and the housing to prevent reoxidation of the materials to be joined so as to assist joining of the materials.

On the other hand, when the coating layer is not applied to the metal outer ring, a newly formed surface is to be immediately oxidized again even if mechanical force is applied to the materials to be joined to break the passivation film. This is because the housing is formed of a metal material by which a passivation film is readily formed. Accordingly, the materials cannot be joined to each other at all, or even if the materials can be joined to each other, the joining strength is relatively weak, so that sufficient airtightness cannot be achieved. Furthermore, even if the metal outer ring provided with a coating layer and the housing having a passivation film are simply brought into contact with each other and then heated to thereby melt the coating layer without using the mechanical method as described above, the passivation film inhibits alloying of the materials to be joined, so that the materials cannot be joined to each other.

According to each of the above-described embodiments, a terminal can be attached to a housing without using flux, so that flux-free can be implemented. Consequently, each of the steps of applying, cleaning and drying flux can be omitted. Also, since joining is performed at the temperature lower than the melting temperature of the material to be joined, the strength of the material to be joined is not decreased. Furthermore, strain and warpage resulting from heating shrinkage of the material to be joined can also be minimized. Even metals that are hard to be joined to each other with solder or a wax material can be simply joined to each other with high quality and with high reliability without using an adhesive and the like. Further, the airtightness at the joint portion is also improved.

As described above, neither flux nor a reducing agent is indispensable for the configuration in each of the above-described embodiments. However, further application of flux, a reducing agent or the like to the configuration in each of the above-described embodiments should not be excluded.

It should be understood that the embodiments disclosed herein are illustrative and non-restrictive in every respect. The scope of the present invention is defined by the terms of the claims, rather than the description above, and is intended to include any modifications within the meaning and scope equivalent to the terms of the claims.

INDUSTRIAL APPLICABILITY

The present invention is applicable to a terminal of an electrical apparatus. The present invention can be suitably utilized, for example, for a hard disk device (HDD device) and the like that includes a housing (an airtight container) having low density gas such as He gas enclosed therein and that requires high airtightness, though not particularly limited thereto.

REFERENCE SIGNS LIST

10, 20, 30, 200 terminal, 11, 21, 31, 51 metal outer ring, 12, 22, 32, 52 insulating material, 13, 23, 33, 53 lead, 14, 24, 34, 54 joint edge, 15, 25, 35, 55 coating layer, 26, 56 protrusion, 36 recess 40 flowchart, 41 preparing step, 42 placing step, 43*a* pre-heating step, 43*b* joining step, 50 terminal-equipped housing, 100 housing, 300 ultrasonic horn.

The invention claimed is:

1. A terminal that can be fixedly adhered to a housing made of a metal material, the terminal comprising:

a metal outer ring;

a lead penetrating through the metal outer ring; and an insulating material for providing sealing between the metal outer ring and the lead, the metal outer ring having a joint edge to be joined to the housing, a coating layer being provided at least in the joint edge, the coating layer turning into a liquid phase at a temperature lower than a melting temperature of the housing.

2. The terminal according to claim 1, wherein the coating layer is made of a metal material having fluidity and configured to cover the joint edge of the metal outer ring at the temperature at which the coating layer turns into a liquid phase, to prevent oxidation of the housing and the joint edge of the metal outer ring for a prescribed time period.

3. The terminal according to claim 1, wherein the coating layer is made of a metal material selected from the group consisting of Sn, an Sn alloy, an Au alloy, an Ag alloy, and a Cu alloy.

4. The terminal according to claim 1, wherein the joint edge has a protrusion or a recess.

5. The terminal according to claim 4, wherein the protrusion is provided so as to continuously extend in a circumferential manner along the joint edge.

6. The terminal according to claim 4, wherein the recess is provided in a groove shape so as to continuously extend in a circumferential manner along the joint edge.

7. The terminal according to claim 4, wherein a plurality of the protrusions or a plurality of the recesses are provided.

8. A terminal-equipped housing arrangement comprising a housing which is made of a metal material and in which an electrical device is housed; and a terminal which is directly joined to the housing, and which comprises:

a metal outer ring;

a lead penetrating through the metal outer ring; and an insulating material for providing sealing between the metal outer ring and the lead, wherein the metal outer ring having a joint edge to be joined to the housing, and a coating layer provided at least in the joint edge, wherein the coating layer is turning into a liquid phase at a temperature lower than a melting temperature of the housing.

9. The terminal-equipped housing arrangement according to claim 8, wherein the housing is made of a metal material by which a passivation film is readily formed or a metal material having a hard-to-solder surface compound.

10. The terminal-equipped housing arrangement according to claim 8, wherein the housing is made of a metal material selected from the group consisting of aluminum, chromium, titanium, iron, nickel, copper, and an alloy thereof.

11. A terminal attaching method of attaching a terminal to a housing, the terminal including:

a metal outer ring, a lead penetrating through the metal outer ring, and an insulating material for providing sealing between the metal outer ring and the lead, the metal outer ring having a joint edge to be joined to the housing, a coating layer being provided at least in the joint edge, the coating layer turning into a liquid phase at a temperature lower than a melting temperature of the housing, the terminal attaching method comprising:

preparing the terminal and a housing that is made of a metal material and has an insertion hole;

positioning and placing the terminal at the insertion hole of the housing; and while heating at least a joint portion between the terminal and the housing to the temperature lower than the melting temperature of the housing, breaking a passivation film formed on a joint portion of the housing using a mechanical method, causing the coating layer, which is molten, to seal a gap between a contact surface of the metal outer ring and a contact surface of the joint portion of the housing, and fixedly adhering the metal outer ring and the housing to each other while preventing reoxidation of the joint portion of the housing.

12. The terminal attaching method according to claim 11, further comprising pre-heating the housing between placing the terminal at the insertion hole and fixedly adhering the metal outer ring and the housing to each other.

13. The terminal attaching method according to claim 11, wherein the mechanical method includes bringing the joint edge and the joint portion of the housing into contact with each other, applying vibrations thereto to scratch a surface of the joint portion of the housing, and pressing the joint edge and the housing against each other.

14. The terminal attaching method according to claim 11, wherein the mechanical method includes bringing a protrusion or a recess provided in the joint edge into contact with the joint portion of the housing, and pressing the protrusion or the recess against the joint portion of the housing, to cause the protrusion or the recess to scratch a surface of the joint portion of the housing and intrude into the surface of the joint portion while sliding on the surface of the joint portion, so as to press the joint edge and the joint portion of the housing against each other.

15. The terminal attaching method according to claim 11, wherein the housing is made of a metal material by which a passivation film is readily formed or a metal material having a hard-to-solder surface compound.

16. The terminal attaching method according to claim 11, wherein the housing is made of a metal material selected from the group consisting of aluminum, chromium, titanium, iron, nickel, copper, and an alloy thereof.

17. The terminal attaching method according to claim 11, wherein the mechanical method includes heating and melting the coating layer, and applying an ultrasonic wave to the joint edge, to break the passivation film on the joint portion of the housing so as to expose a newly formed surface.

18. The terminal attaching method according to claim 17, wherein, in applying the ultrasonic wave to the joint edge, an ultrasonic horn is brought into contact with the joint edge.

19. The terminal attaching method according to claim 17, wherein the ultrasonic wave has a frequency greater than 28 kHz and less than 1 MHZ.

* * * * *